US008517500B2

(12) United States Patent
Hoisington et al.

(10) Patent No.: US 8,517,500 B2
(45) Date of Patent: Aug. 27, 2013

(54) OVERCURRENT DETECTION FOR DROPLET EJECTORS

(75) Inventors: Paul A. Hoisington, Hanover, NH (US); Deane A. Gardner, Cupertino, CA (US)

(73) Assignee: FUJIFILM Corporation, Tokyo (JP)

( * ) Notice: Subject to any disclaimer, the term of this patent is extended or adjusted under 35 U.S.C. 154(b) by 163 days.

(21) Appl. No.: 12/991,892

(22) PCT Filed: May 6, 2009

(86) PCT No.: PCT/US2009/042972

§ 371 (c)(1), (2), (4) Date: Feb. 2, 2011

(87) PCT Pub. No.: WO2009/142908

PCT Pub. Date: Nov. 26, 2009

(65) Prior Publication Data

US 2011/0122179 A1 May 26, 2011

Related U.S. Application Data

(60) Provisional application No. 61/055,016, filed on May 21, 2008.

(51) Int. Cl.
*B41J 29/393* (2006.01)
*B41J 2/045* (2006.01)

(52) U.S. Cl.
CPC ..... *B41J 2/0451* (2013.01)
USPC ..... 347/19

(58) Field of Classification Search
USPC ..... 347/19
See application file for complete search history.

(56) References Cited

U.S. PATENT DOCUMENTS

| | | | |
|---|---|---|---|
| 5,541,628 | A | 7/1996 | Chang et al. |
| 5,736,997 | A | 4/1998 | Bolash et al. |
| 6,305,773 | B1 | 10/2001 | Burr et al. |
| 6,382,754 | B1 | 5/2002 | Morikoshi et al. |
| 6,554,407 | B1 | 4/2003 | Ikeda et al. |

FOREIGN PATENT DOCUMENTS

| | | | |
|---|---|---|---|
| CN | 1463848 | A | 12/2003 |
| CN | 1935525 | A | 3/2007 |
| CN | 101092075 | A | 12/2007 |
| EP | 0574016 | | 12/1993 |
| JP | 62122761 | | 6/1987 |
| JP | 02285932 | * | 11/1990 |
| WO | 2009142908 | | 11/2009 |

OTHER PUBLICATIONS

International Search Report and Written Opinion issued Jul. 2, 2009 in international application No. PCT/US2009/042972, 9 pgs.

(Continued)

*Primary Examiner* — Julian Huffman
(74) *Attorney, Agent, or Firm* — Fish & Richardson P.C.

(57) ABSTRACT

An apparatus, method, and a fluid ejection system for detecting electrical shorts in piezoelectric printheads are described. An apparatus includes a piezoelectric actuator, a transistor whose drain is connected to the piezoelectric actuator, a diode that is connected to a source and the drain of the transistor, a detection circuit configured to detect whether a voltage at the drain of the transistor is above a predefined voltage, and a disabling circuit configured to turning off the transistor in response to detecting that voltage at the drain of the transistor is above the predefined voltage.

9 Claims, 6 Drawing Sheets

(56) References Cited

OTHER PUBLICATIONS

International Preliminary Report on Patentability dated Dec. 2, 2010 issued in international application No. PCT/US2009/042972, 7 pgs.
Office Action dated Aug. 21, 2012 issued in Chinese application No. 2009801180988, 10 pgs.
Office action issued Oct. 30, 2012 in corresponding European application No. 09751137.2, 6 pgs.
Office action dated Mar. 13, 2013 issued in corresponding Chinese application No. 2009801180988, 8 pgs.
Extended European Search Report in European Application No. 13163910.6, dated May 28, 2013, 7 pages.

* cited by examiner

| Reset 420 | On OR All-on (OR gate 410 output) | Greater than ~2 V (comparator 418 output) | Gate signal |
|---|---|---|---|
| 0 | 0 | 0 | 0 |
| 0 | 0 | 1 | 0 |
| 0 | 1 | 0 | 1 |
| 0 | 1 | 1 | 0 |
| 1 | 0 | 0 | 0 |
| 1 | 0 | 1 | 0 |
| 1 | 1 | 0 | 1 |
| 1 | 1 | 1 | 1 |

FIG. 5

OVERCURRENT DETECTION FOR DROPLET EJECTORS

CROSS-REFERENCE TO RELATED APPLICATIONS

This application is the national stage of International Application Number PCT/US2009/042972, filed on May 6, 2009, which is based on and claims the benefit of the filing date of U.S. Provisional Application No. 61/055,016, filed on May 21, 2008, both of which as filed are incorporated herein by reference in their entireties.

BACKGROUND

The subject matter of this specification is related generally to fluid ejectors, e.g., inkjet printheads.

An inkjet printhead can have multiple piezoelectrically controlled ink ejectors, each including a pumping chamber connected to a nozzle. The piezoelectric material can be electrically coupled to an application-specific integrated circuit (ASIC). The ASIC drives the piezoelectric material, which actuates the pumping chamber and ejects the ink from the associated nozzle.

The piezoelectrically controlled ink nozzles, along with the ASICs, can be packed into a relatively small area. Because of the small area and defects or deterioration of electrical paths in the ASICS and the connections between the ASICs and the piezoelectric materials, electrical shorts, and thus overcurrent conditions, can occur. When an overcurrent condition does occur, multiple ink nozzles can become damaged and rendered inoperative.

SUMMARY

In general, one aspect of the subject matter described in this specification can be embodied in an apparatus that includes a piezoelectric actuator; a transistor, whose drain is connected to the piezoelectric actuator; a diode that is connected to a source and the drain of the transistor; a detection circuit configured to detect whether a voltage at the drain of the transistor is above a predefined voltage; and a disabling circuit configured to turn off the transistor in response to detecting that the voltage at the drain of the transistor is above the predefined voltage.

In general, another aspect of the subject matter described in this specification can be embodied in a fluid ejection system that includes a fluid ejection module including one or more droplet ejector units for ejection of ink upon activation of one or more piezoelectric actuators, where a respective droplet ejector unit including a respective piezoelectric actuator; and a droplet ejector driver electrically coupled to the respective piezoelectric actuator. The droplet ejector driver includes a transistor, whose drain is connected to the respective piezoelectric actuator; and one or more circuits for detecting an overcurrent condition at the drain of the transistor and turning the transistor off in response to the detected overcurrent condition, where turning the transistor off disables the respective droplet ejector unit.

In general, another aspect of the subject matter described in this specification can be embodied in a method that includes applying a voltage to a piezoelectric actuator of a droplet ejector unit, detecting an overcurrent condition through a transistor connected to the piezoelectric actuator, and disabling the piezoelectric actuator in response to the detected overcurrent condition.

Particular embodiments of the subject matter described in this specification can be implemented to realize one or more of the following advantages. Individual fluid ejection units can be disabled when an overcurrent condition occurs. The disabling of a fluid ejection unit due to an overcurrent condition can be detected. Disabling the single ejector can prevent the failure mode from cascading into the failure of an entire driver chip, requiring head replacement. For example, collateral damage to the remaining ASIC outputs that control other functioning individual fluid ejection units can be prevented.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIG. 5 illustrates an example logic table for signals for controlling a droplet ejector unit.

Like reference numbers and designations in the various drawings indicate like elements.

DETAILED DESCRIPTION

Although a printer system using ink is described below, the concepts can be generally applicable to other microelectromechanical system-based (MEMS-based) devices that include driven piezoelectric layers, and in particular to fluid ejection systems that eject fluids.

Figure 1:
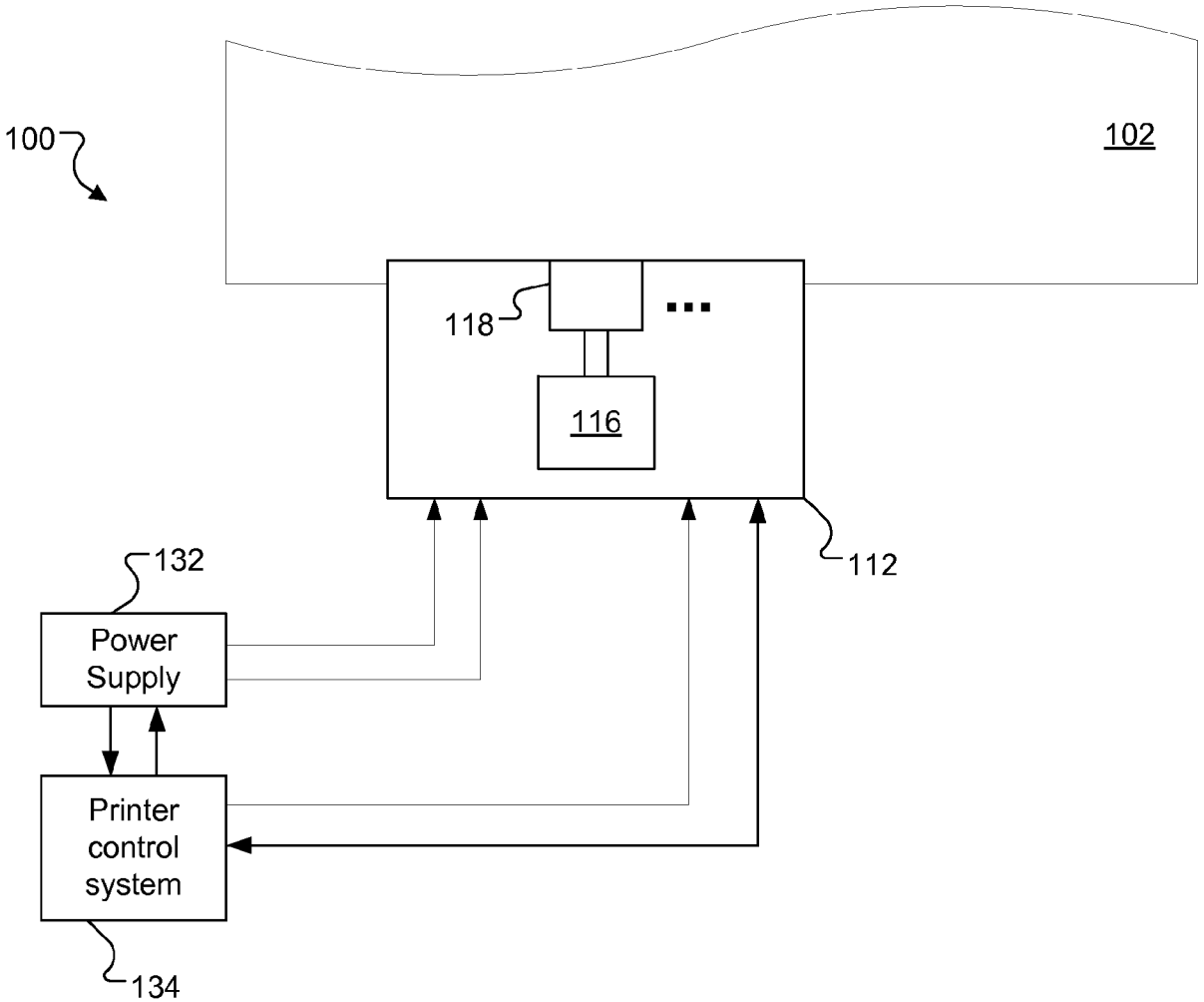
FIG. 1 illustrates a schematic plan for an example printer unit.

FIG. 1 illustrates a schematic plan for an example fluid ejection system, e.g., a printer unit 100. The printer unit 100 includes one or more fluid ejectors, e.g., one or more printheads 112. A printhead 112 can deposit fluid material (e.g., ink) onto a receiving surface 102 (e.g., a recording medium, such as paper, or a substrate undergoing for integrated circuit fabrication). In some implementations, the printhead(s) 112 and/or the receiving surface 102 can be moved or translated relative to each other, so that fluid can be deposited over various locations on the receiving surface 102. For example, a receiving surface 102 that is flat and flexible (e.g., paper) can be translated by one or more rollers driven by a motor, and the printhead(s) 112 can be translated by a cable-and-pulley system driven by a motor. Other mechanisms for moving or translating the recording medium 102 and/or the printhead(s) 112 are possible.

For convenience, the description below refers to paper as the receiving surface 102 and ink as the material to be deposited by the printer unit 100 onto the receiving surface 102.

The printer unit 100 can include a power supply 132 and printer control system 134. The power supply 132 supplies electrical power (which can be sourced from a battery, or some other direct current or alternating current source) to components, circuits, etc. of the printer unit 100. Printer control system 134 include various hardware and software components (e.g., one or more circuits, instructions stored in a computer-readable medium, instructions hardwired into one or more circuits, etc.) for receiving data representing a layout of fluid to be deposited onto a receiving surface 102 (e.g., data representing an image to be printed on paper), processing the data, controlling the printhead(s) 112 to achieve deposition of fluid onto the receiving surface 102 in accordance with the received data, and other functionality. For example, printer control system 134 can receive data representing an image to be printed onto a sheet of paper. Printer control system 134 processes the data and controls the printhead(s) 112 in accordance with the data, in order to achieve the printing of the image onto a sheet of paper. Electronics 134 can control the printhead(s) 112 by turning on or off droplet ejector units in the printhead(s) 112 as needed and controlling the filling of droplet ejector units with ink and the firing of ink droplets from the droplet ejector units.

Each fluid ejector (e.g., printhead 112) includes a fluid ejector module, e.g., printhead module 118. A printhead module 118 can be a rectangular plate-shaped printhead module, which can be a die fabricated using semiconductor processing techniques. Each fluid ejector can also include a housing to support the printhead module, along with other components such as a flex circuit to receive data from an external processor and provide drive signals to the printhead module. An ink supply 116 holds a supply of ink and feeds the printhead module(s) 118 with ink.

Figure 2:
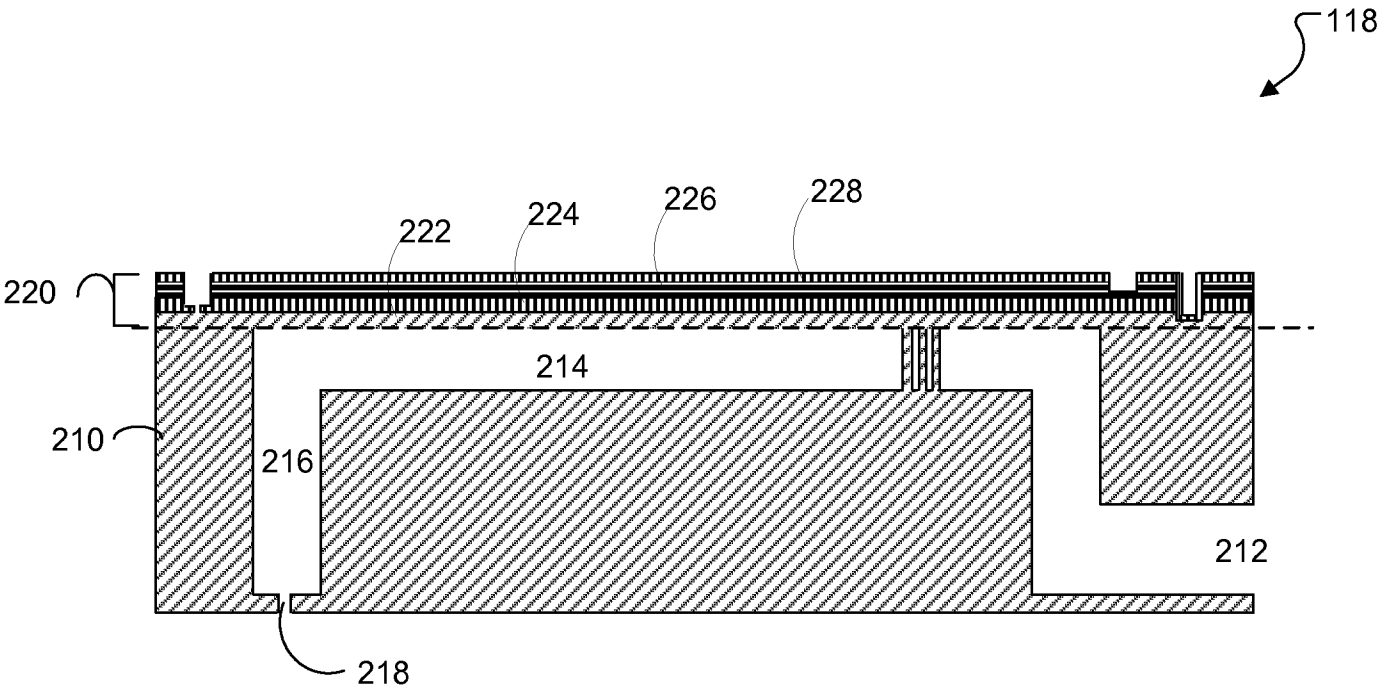
FIG. 2 is a schematic diagram of a cross-sectional view of an example printhead module.

FIG. 2 is a schematic diagram of a cross-sectional view of an example fluid ejector module (e.g., printhead module 118). Printhead module 118 includes a module substrate 210 in which a plurality of fluid flow paths are formed (only one flow path is shown in the cross-sectional view of FIG. 2) and one or more piezoelectric actuator structures 220 (e.g., an actuator including lead zirconium titrate ("PZT") or another piezoelectric material, and electrodes). The module substrate 210 can be a monolithic semiconductor body, such as a silicon substrate. In the printhead module 118, passages through the silicon substrate define a flow path for the fluid to be ejected, e.g., ink. Each flow path (or "droplet ejector unit") can include an ink inlet 212, a pumping chamber 214, and a nozzle 218. A piezoelectric actuator structure 220 is positioned over the pumping chamber 214. Ink flows through the ink inlet 212 (e.g., from ink supply 116) to the pumping chamber 214, where, when a voltage pulse is applied across a piezoelectric material in the piezoelectric actuator structure 220, the ink is pressurized such that it is directed to a descender 216 and out of the nozzle 218. These etched features can be configured in a variety of ways.

The piezoelectric actuator structure 220 includes an actuator membrane 222, a ground electrode layer 224, a piezoelectric layer 226, and a drive electrode layer 228. The piezoelectric layer 226 is a thin film of piezoelectric material. The piezoelectric layer 226 can be composed of a piezoelectric material that has desirable properties such as high density, low voids, and high piezoelectric coefficients. The actuator membrane can be formed from silicon.

In some implementations, the thin film of piezoelectric material is deposited by sputtering. Types of sputter deposition can include magnetron sputter deposition (e.g., RF sputtering), ion beam sputtering, reactive sputtering, ion assisted deposition, high target utilization sputtering, and high power impulse magnetron sputtering. Sputtered piezoelectric material (e.g., piezoelectric thin film) can have a large as deposited polarization. Some types of chambers that are used for sputtering piezoelectric material apply a DC field during sputtering. The DC field causes the piezoelectric material to be polarized such that the exposed side of the piezoelectric material is negatively poled.

The piezoelectric layer 226 with the ground electrode layer 224 on one side is fixed to the actuator membrane 222. The actuator membrane 222 isolates the ground electrode layer 224 and the piezoelectric layer 226 from ink in the pumping chamber 214. The actuator membrane 222 can be silicon and has a compliance selected so that actuation of the piezoelectric layer 226 causes flexing of the actuator membrane 222 that is sufficient to pressurize fluid in the pumping chamber 214.

The piezoelectric layer 226 changes geometry, or bends, in response to an applied voltage (e.g., a voltage applied at the drive electrode layer 228). The bending of the piezoelectric layer 226 pressurizes fluid in the pumping chamber 214 to controllably force ink through the descender 116 and eject drops of ink out of the nozzle 218.

A printhead module 118 has a front surface that defines an array of nozzles 218 of the droplet ejector units. In some implementations, the nozzles 218 are arranged into one or more rows. The printhead module 118 also has a back surface on which a series of drive contacts can be included. In some implementations, there is a drive contact for each droplet ejector unit. The drive contact for a droplet ejector unit is in electrical communication with the piezoelectric actuator structure 220 for the droplet ejector unit. In some implementations, the drive contact for a droplet ejector unit is in electrical communication with the drive electrode layer 228 of the droplet ejector unit.

Figure 3A:
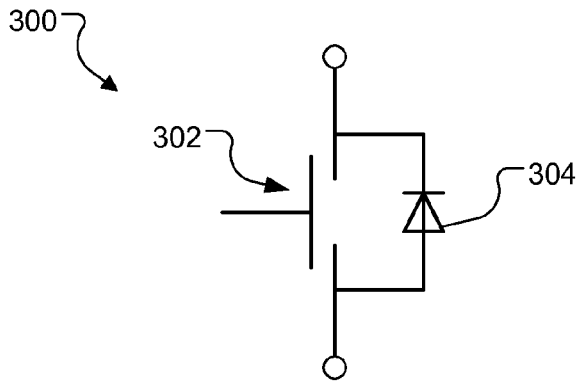
FIG. 3A is a schematic diagram of an example circuit for driving a droplet ejector unit of a printhead module.

FIG. 3A is a schematic diagram of an exemplary circuit 300 for driving a droplet ejector unit of a printhead module (e.g., the printhead module 118). In some implementations, the circuit is external to the printhead module. In some implementations, the circuit is integrated into the printhead module, e.g., formed on the substrate 210 or on an ASIC that is attached to the substrate. The circuit 300 includes an N-type double-diffused metal oxide semiconductor (NDMOS) transistor 302 coupled to a diode 304 (e.g., a semiconductor diode). The anode of the diode 304 is coupled to the source of the NDMOS transistor 302, and the cathode of the diode 304 is coupled to the drain of the NDMOS transistor 302.

In some implementations, one or more instances of circuit 300 can be fabricated on an integrated circuit element, e.g., one per droplet ejector unit to be controlled by the integrated circuit element. For example, the integrated circuit element can be attached to a printhead module die. In some alternative implementations, because of the use of NDMOS transistors, the size of the circuit 300 can be reduced, and the circuit 300 can be integrated directly onto the die.

Because the current between the drain and source of a transistor is limited by the current through the gate of the transistor, the transistor can be used as a switch. In particular, the NDMOS transistor 302 is used as a switch to controllably actuate a piezoelectric actuator structure to drive a printhead module. For example, the NDMOS transistor 302 is "on" when the gate of the transistor 302 is driven with a voltage that is higher than its gate threshold voltage, and the transistor 302 is "off" when the gate is driven with a voltage that is lower than the gate threshold voltage. In addition, the current through the gate of the NDMOS transistor 302 can also be used to control the current through the drain of the NDMOS transistor 302 to control the bias of the diode 304 (e.g., selectively forward bias or reverse bias the diode).

Figure 3B:
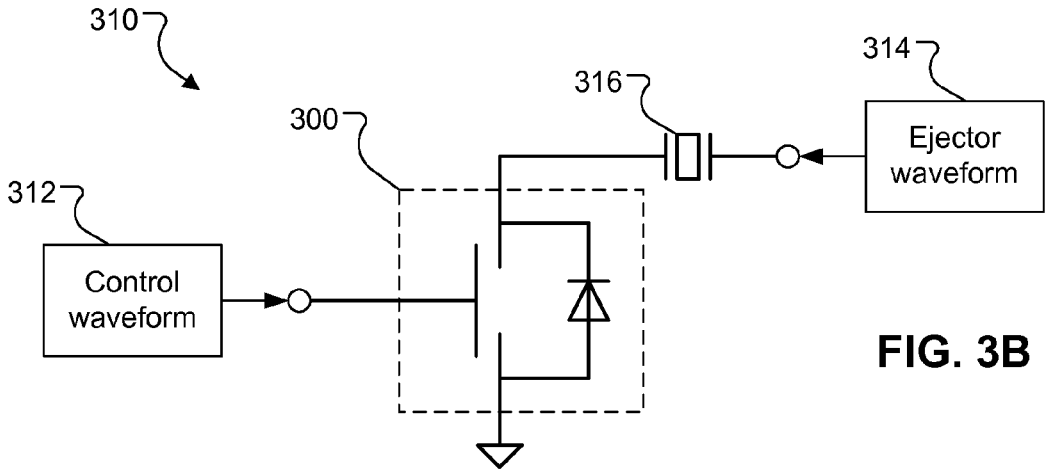
FIG. 3B is a schematic diagram that includes an example droplet ejector driver.

FIG. 3B is a schematic diagram that includes an example droplet ejector driver 310. The droplet ejector driver 310 includes the circuit 300 and a piezoelectric actuator structure 316 (e.g., a PZT). In some implementations, the drain of the NDMOS transistor 302 is coupled to the piezoelectric actuator structure 316 (e.g., at the drive electrode layer 228 of the piezoelectric actuator structure 220, e.g. through a corresponding drive contact). The drain of the NDMOS transistor 302 can be coupled to the electrode on a surface of the piezoelectric actuator structure 316 that had a negative voltage applied to it during poling; this prevents reverse biasing of the piezoelectric actuator structure 316. In some implementations, if the piezoelectric material of the piezoelectric actuator structure 316 is sputtered, the drain of the NDMOS transistor 302 is coupled to the top surface (i.e., the exposed surface) of the sputtered piezoelectric material; this is equivalent to connecting the drain of the NDMOS transistor 302 to the surface of the piezoelectric actuator structure 316 that had a negative voltage during poling. The other electrode of the piezoelectric actuator structure 316 (e.g., the ground electrode 224) is further coupled to a waveform generator 314 configured to generate an ejector waveform or signal. In some implementations, the ejector waveform generator 314 is a part of the printer control system 134. The gate of the NDMOS transistor 302 is coupled to a waveform generator 312 configured to generate a control waveform or signal (e.g., a driver circuit). In some implementations, the control waveform generator 312 is a part of the printer control system 134. In some implementations, the control waveform generator 312 can include one or more circuits and electrical components. The source of the NDMOS transistor 302 is coupled to ground.

Figure 3C:
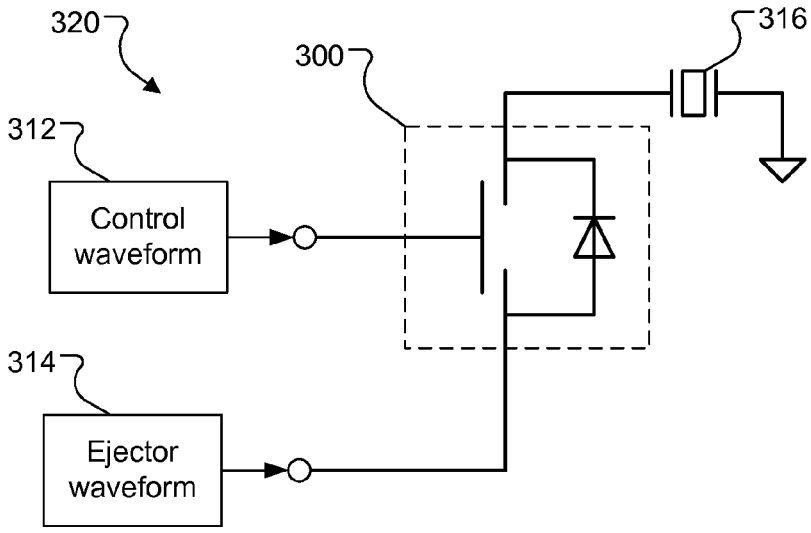
FIG. 3C is a schematic diagram that includes another example droplet ejector driver.

FIG. 3C is a schematic diagram that includes another example droplet ejector driver 320. The droplet ejector driver 320 includes the circuit 300 and a piezoelectric actuator structure 316. In some implementations, the drain of the NDMOS transistor 302 is coupled to one electrode of the piezoelectric actuator structure 316 (e.g., at the drive electrode layer 228 of the piezoelectric actuator structure 220). The other electrode of the piezoelectric actuator structure 316 is further coupled to ground (e.g., at the ground electrode layer 224 of the piezoelectric actuator structure 220). The gate of the NDMOS transistor 302 is coupled to a waveform generator 312 configured to generate a control waveform or signal (e.g., a driver circuit). In some implementations, the control waveform generator 312 can include one or more circuits and electrical components. In some implementations, the control waveform generator 312 is a part of the printer control system 134. The source of the NDMOS transistor 302 is coupled to the waveform generator 314 configured to generate an ejector waveform or signal. In some implementations, the ejector waveform generator 314 is a part of the printer control system 134.

Thus, in FIGS. 3B and 3C, droplet ejection from different nozzles can be individually controlled by applying different control waveforms to the individual circuits 300 for each fluid ejector unit. However, the same ejection waveform can be applied to each fluid ejector unit. The ejection waveform can be an inverse trapezoidal waveform, for example. The waveforms are applied such that the piezoelectric actuator structure 316 is operated in a way that a voltage across the piezoelectric actuator structure 316 produces a current into the NDMOS transistor 302, rather than diode 304, in the event of an electrical short.

The control waveform generator 312 for a droplet ejector unit can include overcurrent detection capability. That is, the control waveform generation 312 can be configured to detect overcurrents in the droplet ejector unit caused by electrical shorts across the piezoelectric actuator structure 316 and to disable the droplet ejector unit in response to the detected overcurrent.

Figure 4:
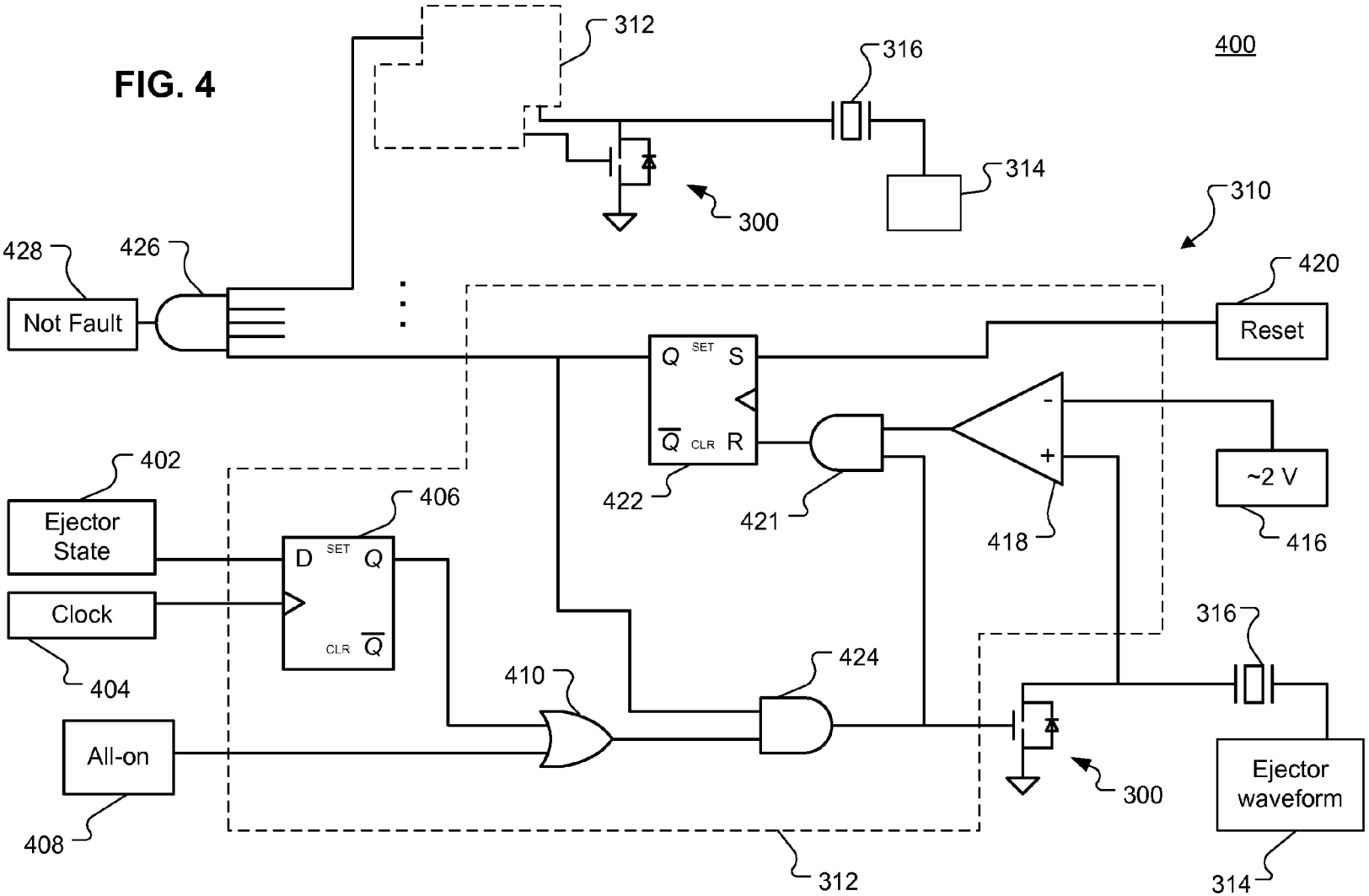
FIG. 4 illustrates a block diagram for an example printhead module driver with overcurrent detection.

FIG. 4 illustrates a block diagram for an example droplet ejector driver 310 with overcurrent detection. More particularly, the droplet ejector driver 310 includes a control waveform generator (e.g. driver circuit) 312 that is configured to detect overcurrent conditions. There is a driver circuit 312 for each droplet ejector unit; the driver circuit 312 detects overcurrent conditions across the piezoelectric actuator structure 316 for an individual droplet ejector unit and can disable the individual droplet ejector unit if an overcurrent condition is detected.

While FIG. 4 illustrates a driver circuit 312 with overcurrent detection within droplet ejector driver 310, similar driver circuits with overcurrent detection can be used in droplet ejector driver 320 or in other droplet ejector driver configurations.

The driver circuit 312 is connected to circuit 300 at the gate and the drain of the transistor 302. The driver circuit 312 includes an output to the gate of the transistor 302 and an input from the drain of the transistor 302, details of which are described below.

The waveform generator 312 can include a D-flip-flop (or D-latch) 406. The D-input of the D-flip-flop 406 receives an ejector state signal 402 (e.g., from printer control system 134) and optionally a clock signal 404. The ejector state signal 402 signals a desired state of the droplet ejector unit, e.g., whether the droplet ejector unit is to eject a droplet of ink ("on") or not eject ink ("off"). For example, the ejector state signal 402 can be high for the "on" state and low for the "off" state. In the context of a printing system, the nozzle state signal can indicate whether a pixel is to be printed, and can be derived from image data by the printer control system 134. The D-flip-flop 406 retains the received ejector state signal 402.

The Q-output of the D-flip-flop 406 can be OR'ed with an All-on signal 408 using an OR-gate 410. The All-on signal 408 can be sent by the printer control system 134. The All-on signal 408 is a signal that can be sent to the droplet ejector drivers of multiple droplet ejector units. A high All-on signal 408 can be asserted to activate multiple droplet ejector units all at once.

The waveform generator 312 can also include an SR-flip-flop (or SR-latch) 422. The SR-flip-flop 422 can receive a Reset signal 420 for the S-input of the SR-flip-flop 422. The reset signal can be sent by the printer control system 134, for example, or by another source external to the drive circuit 312. A high Reset signal 420 can be used to initialize the state of a droplet ejector unit, as described in further detail below. The SR-flip-flop 422 can also optionally receive a clock signal. In some implementations, the same Reset signal 420 is sent to multiple (e.g., all) droplet ejector units. In some other implementations, each droplet ejector unit receives a respective Reset signal 420.

The Q-output of the SR-flip-flop 422 can be combined with the output of OR-gate 410 using an AND-gate 424. The output of the AND-gate 424 is connected to the gate of the transistor 302; the output of the AND-gate 424 outputs the control waveform that turns the transistor 302 on or off by applying a high or low signal (i.e., a high or low voltage) to the gate of the transistor 302. Due to the AND operation applied by the AND-gate 424, if the Q-output outputs a low signal, the AND-gate 424 outputs a low signal to the gate of the transistor 302 and the transistor 302 is turned off.

The output of AND-gate 424 is also connected to an input of another AND-gate 421. AND-gate 421 can combine the output of the AND-gate 424 and the output of a comparator 418. The comparator receives a substantially constant voltage 416 at one input and the drain voltage of the transistor 302 at the other input. In some implementations, the constant voltage 416 is approximately 2 V. More generally, the constant voltage 416 can be a maximum voltage amount that can be applied to the droplet ejector driver 310 without damaging the droplet ejector driver 310 while the drop ejector driver 310 is in an "on" condition (i.e., transistor 302 is in an "on" condition). If the constant voltage 416 is higher than the drain voltage, the comparator 418 outputs a low signal. If the constant voltage 416 is equal to or lower than the drain voltage, the comparator 418 outputs a high signal. The output of the AND-gate 421 is transmitted into the R-input of the SR-flip-flop 422. A high or low signal is outputted at the Q-output of the SR-flip-flop in accordance with the Reset signal 420 and the output of the AND-gate 421. In some implementations, a filtering block can be added between AND-gate 421 and SR-flip-flop 422 to prevent triggering the flip-flop during brief transients, for example, as NDMOS transistor 302 turns on from a previous off state.

The Q-output of the SR-flip-flop 422 outputs a signal that can turn off the transistor 302, as described above, and as a result disable the droplet ejector unit. Thus, the Q-output of the SR-flip-flop 422 indicates whether an overcurrent condition has occurred. If the Q-output of the SR-flip-flop 422 is high, then there is no overcurrent condition for the respective droplet ejector unit. If the Q-output of the SR-flip-flop 422 is low, then there is an overcurrent condition for the respective droplet ejector unit.

The Q-outputs of the respective SR-flip-flops 422 of multiple waveform generators 312 of multiple droplet ejector units can be combined by an AND-gate 426. The output of the AND-gate 426 is a Not Fault signal 428. A high Not Fault signal 428 indicates that there is no overcurrent condition amongst the droplet ejector units from which the Q-outputs were combined. A low Not Fault signal 428 indicates that at least one of the droplet ejector units from which the Q-outputs were combined has an overcurrent condition. Alternatively, the complement of the Q-outputs of the SR-flip-flops 422 of multiple waveform generators 312 of multiple droplet ejector units can be combined using an OR-gate into a Fault signal. A high Fault signal indicates that at least one of the droplet ejector units has an overcurrent condition.

In some implementations, one or more particular droplet ejector units that suffer an electrical short (i.e., have an overcurrent condition) can be identified by turning off all of the droplet ejector units and then activating them one at a time. A low Not Fault signal (or a high Fault signal) indicates that the particular activated droplet ejector unit suffers from an overcurrent condition and should not be used. In another implementation, instead of turning each ejector on one at a time, ejectors that were previously determined to be shorted, if any, are skipped (i.e., not turned on since their shorted status is known). Identifying the drop ejector that has been disabled allows the printer controller to compensate for the disabled drop ejector by ejecting more fluid from neighboring drop ejectors, for example. In some other implementations, other algorithms (e.g., binary search) for identifying shorted ejector units can be used.

The droplet ejector driver 310 can be initialized by asserting a high All-on signal 408 and a high Reset signal 420 together for a brief time (e.g., a few microseconds). The initialization forces the transistor 302 on and sets the Q-output of the SR-flip-flop 422 to high. After the initialization, a low All-on signal 408 and a low Reset signal 420 can be asserted, and droplet ejector driver 310 can operate as described above and below. Such an initialization sequence can reduce the stress on the transistors that are connected to shorted ejectors.

In some implementations, a high All-on signal 408 and a high Reset signal 420 are asserted while the signal to the piezoelectric actuator structure 316 (i.e., the signal from the drain of the transistor 302) is at ground. The voltage of the signal to the piezoelectric actuator structure 316 can then be increased in stages (e.g., a less than full voltage for a first stage, and full voltage for a second stage) to test the droplet ejector driver 310 for overcurrent conditions.

In some other implementations, the transistor 302 can be turned on or off in accordance with a logic table. The output of OR-gate 410 (the OR of the Q-output of D-flip-flop 406 and All-on signal 408), the Reset signal 420, and the drain voltage of the transistor 302 can be used as inputs for a logic table to determine a high or low signal to be applied to the gate of the transistor 302. FIG. 5 illustrates an example logic table with the combinations of input signals and the output gate signal for each input combination.

Figure 6:
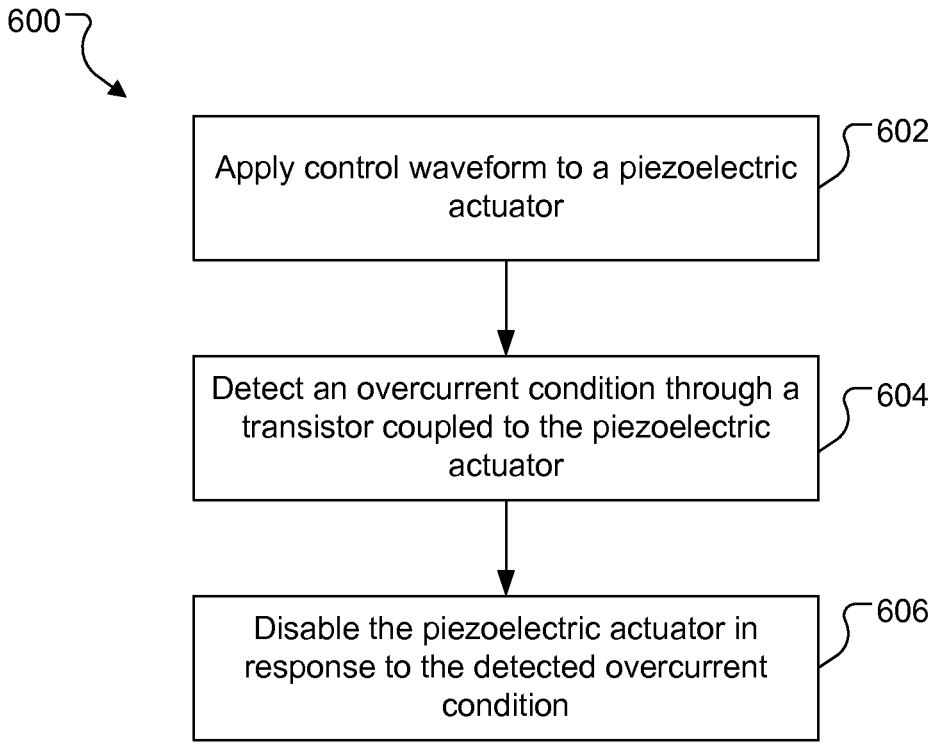
FIG. 6 is a flow diagram illustrating an example process for disabling a droplet ejector unit in response to an overcurrent condition.

FIG. 6 is a flow diagram illustrating an example process 600 for disabling a droplet ejector unit. For convenience, the process will be described with reference to an apparatus or system (e.g., droplet ejector driver 310) that performs the process.

A control waveform is applied to the piezoelectric actuator (e.g., piezoelectric actuator structure 316) of a droplet ejector unit (602). After the droplet ejector driver 310 of a droplet ejector unit is initiated, the droplet ejector unit can be activated (i.e., ink ejection from the droplet ejector unit can be activated) by asserting a high ejector state signal 402. The high ejector state signal 402 is retained and output by the D-flip-flop 406. OR-gate 410 outputs a high signal as a result of the high output signal from the D-flip-flop 406. The SR-flip-flop 422 outputs a high signal following initialization using a high Reset signal 420 and then a low Reset signal 420; the high Reset signal 420 forces the Q-output of the SR-flip-flop 422 to high, then the low Reset signal 420 forces the SR-flip-flop 422 to keep state until an overcurrent condition occurs. With both the outputs of the OR-gate 410 and of the SR-flip-flop 422 outputting high signals, the gate of the transistor 302 receives a high signal waveform from the AND-gate 424, which turns the transistor 302 on. Turning on the transistor 302 activates the piezoelectric actuator structure 316.

An overcurrent condition is detected through the transistor 302 connected to the piezoelectric actuator structure 316 (604). For example, if there is an electrical short across the piezoelectric actuator structure 316, an overcurrent condition occurs through the transistor 302 and the voltage at the drain of the transistor 302 increases as a result. The increased voltage at the drain of the transistor 302 is received at an input of comparator 418 for comparison with a predetermined, predefined, or otherwise substantially constant voltage 416. If the drain voltage is equal to or higher than voltage 416, the comparator 418 outputs a high signal. In other words, the comparator 418 can detect drain voltages higher than a predetermined voltage (e.g., a maximum safe voltage), an indicator of an overcurrent condition.

The piezoelectric actuator structure 316 is disabled in response to the detected overcurrent condition (606). The comparator 418 outputs a high signal in response to a voltage of the drain of the transistor 302 that is above a predetermined voltage 416. AND-gate 421 combines the high gate signal (output of AND-gate 424 while the droplet ejector unit is on) and the output of the comparator 418 to produce a high signal into the R-input of the SR-flip-flop 422. The SR-flip-flop 422 receives the high signal at the R-input and a low Reset signal 420 at the S-input, and generates a low Q-output signal as a result. The low signal is fed back into AND-gate 424, which produces a low signal for the gate of the transistor 302 as a result. The low signal for the gate turns off the transistor 302 and turns off the droplet ejector unit as a result.

The printer unit 100, based on a low Not Fault signal 428 caused by the detected overcurrent condition, can take corrective measures (e.g., make further use of other droplet ejector units to compensate for the loss of the disabled droplet ejector unit, run diagnostics to identify the particular droplet ejector unit that is disabled, etc.).

While this specification contains many specifics, these should not be construed as limitations on the scope of what being claims or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Particular embodiments of the subject matter described in this specification have been described. Other embodiments are within the scope of the following claims.

What is claimed is:

1. A method comprising:

applying a voltage to a piezoelectric actuator structure of a droplet ejector unit;

detecting whether a voltage at a drain of a transistor is above a predetermined voltage, the transistor being connected to the piezoelectric actuator structure; and disabling the piezoelectric actuator structure by applying a voltage that is below a gate threshold voltage at a gate of the transistor, wherein disabling the piezoelectric actuator structure comprises outputting a signal by an SR flip-flop that causes the voltage below the gate threshold voltage to be applied to the gate of the transistor if the voltage at the drain of the transistor is above the predetermined voltage while the voltage at the gate of the transistor is higher than the gate threshold voltage, using an output of the SR flip-flop and an output of an OR gate as inputs to an AND gate, wherein the AND gate applies the voltage to the gate of the transistor, wherein the SR flip-flop outputs a low signal to the AND gate if the voltage at the drain of the transistor is higher than the predetermined voltage while the voltage at the gate of the transistor is higher than the gate threshold voltage.

2. The method of claim 1, wherein disabling the piezoelectric actuator structure comprises turning off the transistor.

3. The method of claim 1, further comprising:

outputting an indication that the piezoelectric actuator structure is disabled.

4. The method of claim 1, further comprising:

enabling a plurality of driver ejector units one at a time, wherein a signal indicating whether any of the plurality of driver ejector units is disabled takes on a value based on the enabling; and identifying one or more of the plurality of driver ejector units that suffer an overcurrent condition using the signal indicating whether any of the plurality of driver ejector units is disabled.

5. A droplet ejector driver comprising:

a piezoelectric actuator structure;

a transistor electrically coupled to the piezoelectric actuator structure, wherein the piezoelectric actuator structure is disabled when a voltage at a gate of the transistor is below a gate threshold voltage;

an SR flip-flop;

wherein the SR flip-flop outputs a signal that causes a voltage below the gate threshold voltage to be applied to the gate of the transistor if a voltage at a drain of the transistor is higher than a predetermined voltage while the voltage at the gate of the transistor is higher than the gate threshold voltage, and an AND gate having an output of the SR flip-flop and an output of an OR gate as inputs, wherein the AND gate applies the voltage to the gate of the transistor, wherein the SR flip-flop outputs a low signal to the AND gate if the voltage at the drain of the transistor is higher than the predetermined voltage while the voltage at the gate of the transistor is higher than the gate threshold voltage.

6. The droplet ejector driver of claim 5, comprising multiple piezoelectric actuator structures, each piezoelectric actuator structure having a corresponding transistor, a corresponding SR flip-flop, and a corresponding AND gate, wherein outputs from the AND gates are combined into a signal indicating whether at least one piezoelectric actuator structure is turned off.

7. The droplet ejector driver of claim 5, further comprising a D flip-flop having an ejector state signal as an input, and wherein the OR gate has an output of the D flip-flop and an All-On signal as inputs.

8. The droplet ejector driver of claim 7, wherein the SR flip-flop receives a Reset signal at an S input of the SR flip flop; and wherein the droplet ejector driver is configured for initialization by concurrent assertion of a high All-On signal and a high Reset signal.

9. The droplet ejection driver of claim 5, comprising a waveform generator coupled to the piezoelectric actuator structure to apply waveform signals to the piezoelectric actuator structure that when the transistor is turned off, no waveform signals are applied to the piezoelectric actuator structure while the waveform generator remains coupled to the piezoelectric actuator structure.

* * * * *